US007507451B2

(12) United States Patent
Missell et al.

(10) Patent No.: US 7,507,451 B2
(45) **Date of Patent: *Mar. 24, 2009**

(54) FUSIBLE REACTIVE MEDIA

(75) Inventors: Gregory E. Missell, Penfield, NY (US); Lawrence P. DeMejo, Rochester, NY (US); Xiaoru Wang, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/077,614

(22) Filed: Mar. 11, 2005

(65) Prior Publication Data

US 2006/0204684 A1 Sep. 14, 2006

(51) Int. Cl.
*B41M 5/00* (2006.01)
*B41M 5/40* (2006.01)

(52) U.S. Cl. ..... 428/32.24; 428/32.25; 428/32.26; 428/32.27; 428/32.28; 428/32.34

(58) Field of Classification Search ..... 428/32.25, 428/32.27, 32.28, 32.29, 32.3, 32.31, 32.34, 428/32.37, 32.38, 32.24, 32.26
See application file for complete search history.

(56) References Cited

U.S. PATENT DOCUMENTS 6,089,704 A * 7/2000 Burns et al. ..... 428/32.23
6,114,020 A * 9/2000 Misuda et al. ..... 428/32.35
6,346,353 B1 2/2002 Wang et al.
6,436,617 B1 * 8/2002 Wang et al. ..... 430/350
6,492,005 B1 * 12/2002 Ohbayashi et al. ..... 428/32.29
6,497,480 B1 * 12/2002 Wexler ..... 347/102
6,548,182 B1 4/2003 Field et al.
6,550,909 B2 * 4/2003 Ichinose et al. ..... 347/105
6,695,447 B1 * 2/2004 Wexler ..... 347/105
2005/0162495 A1 * 7/2005 Wexler ..... 347/105
2006/0003112 A1 * 1/2006 DeMejo et al. ..... 428/32.34
2006/0003115 A1 * 1/2006 DeMejo et al. ..... 428/32.34

FOREIGN PATENT DOCUMENTS

EP 0 286 427 A2 * 10/1988
EP 0 320 594 A2 6/1989
EP 0 995 611 A2 * 4/2000
EP 1 188 573 3/2002
EP 1 293 356 A2 * 3/2003

* cited by examiner

*Primary Examiner*—Betelhem Shewareged
(74) *Attorney, Agent, or Firm*—Chris P. Konkol; Arthur E. Kluegel

(57) ABSTRACT

An inkjet recording element comprises a support having thereon in order, from top to bottom, a fusible, porous layer comprising fusible multifunctional polymer particles derived from an aqueous dispersion that comprise a thermoplastic polymer with at least two reactive functional groups capable of crosslinking with each other. Optionally, an ink-carrier-liquid receptive layer is present between the fusible, porous layer and the support. Also disclosed is a method of inkjet printing on the element.

23 Claims, No Drawings

FUSIBLE REACTIVE MEDIA

CROSS-REFERENCE TO RELATED APPLICATIONS

The present application is related to U.S. application Ser. No. 11/078,229 by WANG et al. and entitled, "MULTI-FUNCTIONAL POLYMER PARTICLES AND METHODS OF MAKING THE SAME," U.S. application Ser. No. 11/078,275 by Missell et al. and entitled, "FUSIBLE REACTIVE MEDIA COMPRISING CROSSLINKER-CONTAINING LAYER," and U.S. application Ser. No. 11/078,274 by Missell et al. and entitled, "INKJET MEDIA COMPRISING MIXTURE OF FUSIBLE REACTIVE POLYMER PARTICLES," all filed concurrently herewith.

FIELD OF THE INVENTION

The present invention relates to an inkjet recording element and a printing method using the element. More specifically, the invention relates to a recording element in which the top layer comprises fusible multifunctional polymer particles that contain at least two complementary crosslinking functionalities in the same particle, including the same polymer molecule, and/or another such particle when the layer is fused.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically comprises a support having on at least one surface thereof at least one ink-receiving layer. The ink-receiving layer is typically either a porous layer that imbibes the ink via capillary action or a polymer layer that swells to absorb the ink. Transparent swellable hydrophilic polymer layers do not scatter light and therefore afford optimal image density and gamut, but may take an undesirably long time to dry. Porous ink-receiving layers are usually composed of inorganic or organic particles bonded together by a binder. During the inkjet printing process, ink droplets are rapidly absorbed into the coating through capillary action, and the image is dry-to-touch right after it comes out of the printer. Therefore, porous coatings allow a fast "drying" of the ink and produce a smear-resistant image; however, porous layers, by virtue of the large number of air-particle interfaces, scatter light that may result in lower densities of printed images.

Furthermore, inkjet prints prepared by printing onto inkjet recording elements are subject to environmental degradation. They are especially vulnerable to damage resulting from contact with water and atmospheric gases such as ozone. Ozone can bleach inkjet dyes resulting in loss of density. Porous layers are particularly vulnerable to atmospheric gases in view of the open pores. The damage resulting from the post-imaging contact with water can take the form of water spots resulting from deglossing of the top coat, dye smearing due to unwanted dye diffusion, and even gross dissolution of the image recording layer. To overcome these deficiencies, inkjet prints are often laminated. However, lamination is expensive, requiring a separate roll of material.

Efforts have been made to avoid lamination and yet provide protected inkjet prints by providing an inkjet receiver having an uppermost fusible, porous layer. Such inkjet elements are known in the art. Fusing the upper layer after printing the image has the advantage of both providing a protective overcoat for water and stain resistance and reducing light scatter for improved image quality.

For example, U.S. Pat. Nos. 4,785,313 and 4,832,984 relate to an inkjet recording element comprising a support having thereon an upper fusible, porous ink-transporting layer and a lower swellable polymeric ink-retaining layer, wherein the ink-retaining layer is non-porous.

EP 858905A1 relates to an inkjet recording element having a fusible porous ink-transporting outermost layer, formed by heat sintering thermoplastic particles, and an underlying porous ink-retaining layer to absorb and retain the ink applied to the outermost layer to form an image. The underlying porous ink-retaining layer is constituted mainly of refractory pigments. After imaging, the outermost layer is made non-porous.

EP 1,188,573 A2 relates to an inkjet recording material comprising in order: a sheet-like paper substrate, at least one pigment layer coated thereon, and at least one sealing layer coated thereon. Also disclosed is an optional dye-trapping layer present between the pigment layer and the sealing layer.

U.S. Pat. No. 6,497,480 to Wexler discloses inkjet media comprising both a fusible ink-transporting layer and a fusible dye-trapping layer. A base layer under the fusible layers may be employed to absorb ink-carrier-liquid fluid.

Protective overcoats and crosslinked overcoats for imaging elements are also known in the art. For example, U.S. Pat. No. 6,436,617 relates to protective overcoats, for photographic image elements, comprising water-dispersible latex particles, which particles comprise an epoxy material and a thermoplastic acid polymer, a water-soluble hydrophilic polymer, and a hydrophobically modified associative thickener. The hydrophilic polymer is substantially washed out during photographic processing facilitating the coalescence of the other materials. Another driving force for this coalescence is the elevated temperature during the drying associated with photoprocessing.

U.S. Pat. No. 6,548,182 relates to an inkjet recording material wherein a coating comprises a water-soluble polymer having a plurality of carboxyl groups in combination with a water-soluble oxazoline compound as a crosslinking agent. EP 0 320 594 A2 discloses aqueous crosslinkable resin dispersions for use in fusible inkjet media, however, in which polymeric particles react with an emulsifier compound.

Commonly assigned U.S. Ser. No. 10/881,127 discloses an inkjet recording element comprising a support having thereon in order from the top:

(a) a fusible, porous pigment-trapping layer comprising (i) fusible polymer particles comprising a thermoplastic polymer with reactive functional groups, (ii) a polyfunctional compound having complementary reactive functional groups capable of crosslinking the reactive functional groups on the thermoplastic polymer, and (iii) an optional binder; and (b) an optional ink-carrier-liquid receptive layer. The support may also function as a liquid-absorbing sump layer either alone or in combination with the optional ink-carrier-liquid receptive layer.

Similarly, commonly assigned U.S. Ser. No. 10/881,264 discloses an inkjet recording element comprising a support having thereon, in order from the top:

(a) a fusible, porous ink-transporting layer comprising (i) fusible polymer particles comprising a thermoplastic polymer with reactive functional groups, (ii) a polyfunctional compound having complementary reactive functional groups capable of crosslinking the reactive functional groups on the thermoplastic polymer, and (iii) an optional binder;

(b) a fusible dye-trapping layer comprising fusible polymer particles, a dye mordant, and an optional hydrophilic binder; and (c) an optional an ink-carrier-liquid receptive layer.

It is an object of this invention to provide an improved inkjet recording element comprising an upper porous layer that can be fused after printing, thereby obtaining high-density images. It is another object of the invention to provide an improved inkjet recording element having a protective upper porous layer that can be fused after printing to render images resistant to water and stain.

SUMMARY OF THE INVENTION

These and other objects are achieved in accordance with the invention that comprises an inkjet recording element comprising a support having thereon in order:

a) an upper fusible, porous layer comprising (i) fusible multifunctional polymer particles each such particle comprising a thermoplastic polymer with at least two different reactive functional groups that can crosslink with each other in the same polymer molecule, particle and/or with such reactive functional groups in another such particle, and (ii) an optional binder; and b) an optional lower porous layer that is fusible or non-fusible and that is receptive to ink-carrier liquid, which may optionally comprise a mordant.

The support may optionally function as a liquid-absorbing or sump layer either alone or in combination with the optional lower porous layer. This inkjet recording element includes that intended for use with dye-based inks, pigment-based inks, or both. In the case of printing with dye-based inks, the inkjet recording element may be designed for the lower porous layer to preferably function as a primary dye-trapping layer separate from the upper fusible, porous layer. In the case of printing with pigment-based inks, the inkjet recording element may be designed either without a lower porous layer or for the lower porous layer to preferably function as a sump layer; however, it is also possible for the upper fusible, porous layer to function as either a dye-trapping or a pigment-trapping layer, depending on the ink composition used for printing, with the optional lower porous layer functioning as a sump layer.

In a first embodiment, the upper fusible, porous layer is designed to preferably function as a pigment-trapping upper layer.

In a second embodiment, the upper fusible, porous layer is designed to preferably alternatively function as both a pigment-trapping layer and a dye-trapping layer, i.e., the printed image is formed in the upper fusible, porous layer irrespective of the ink composition.

In yet a third embodiment, the upper fusible, porous layer is designed to preferably function as an ink-receptive layer and, below the upper fusible, porous layer, there is a lower fusible, porous dye-trapping layer comprising fusible polymer particles (not necessarily crosslinkable), an optional dye mordant, and an optional hydrophilic binder. Also, optionally, an ink-carrier-liquid receptive layer is below the lower fusible, porous dye-trapping layer.

In this third embodiment, the dye-trapping layer and/or the support may optionally function as a liquid-absorbing sump layer to some extent, either alone or in combination with the optional ink-carrier-liquid receptive layer.

Also, in this third embodiment, the upper fusible, porous layer may optionally comprise a hydrophobic polymeric binder to promote the transfer of a portion or all of the aqueous ink, including dye to a lower layer comprising more hydrophilic materials. Thus, the colorant in the ink can be distributed between two fusible layers or, alternatively, substantially all of the ink colorant can be transported to the lower fusible, porous dye-trapping layer, in which case the upper fusible, porous layer may be referred to as an ink-transporting layer.

Although the first and third embodiments described above involve recording elements designed preferably for printing with either pigment-based inks or dye-based inks, it is also possible to print on them with either type of inks. For example, the ink-transporting layer in the second embodiment can also function as a pigment-trapping layer, or the pigment-trapping layer can also function as a dye-trapping layer. Also, as in the second embodiment, it is possible to design a "universal" recording element intended for use, irrespective of whether pigment or dye-based inks are employed. In a preferred embodiment of such a universal recording element, there is no separate dye-trapping layer under the upper fusible, porous layer and, accordingly, only one fusible layer.

In a preferred embodiment of the invention, the fusible multifunctional polymer particles are substantially spherical and monodisperse. Monodisperse particles may be advantageous for controlling fluid absorption and can be used to improve dry time. On the other hand, monodispersed particles may be more difficult to make.

The UPA monodispersity ("Dp"), which is defined as the weight average molecular weight divided by the number average molecular weight of the polymers in the bead, is preferably less than 1.5, more preferably less than 1.3, most preferably less than 1.1, as measured by a Microtrac® Ultra Fine Particle Analyzer (Leeds and Northrup) at a 50% median value. This is another way of saying that the particle size distribution is relatively narrow which, in combination with the particle (or "bead") size, is important for the desired capillary action.

By use of the invention, an inkjet recording element is obtained that when printed with inkjet ink, and subsequently fused, has improved water resistance and stain resistance and high print density.

Inkjet media made in accordance with the present invention may exhibit additional advantageous properties. In some cases, the crosslinking reaction may improve gloss durability. Another potential advantage is that the invention allows the use of lower Tg polymers in the fusible particles, which in turn allows relatively lower fusing temperatures.

Still another potential advantage is that, since the fusible multifunctional polymer particles in the inkjet recording element comprise a thermoplastic polymer that is later crosslinked during fusing, such polymer particles can start (exist before fusing) at a lower Tg than prior-art polymer particles that are not later crosslinked. After fusing, the Tg of the multifunctional polymer particles can then increase due to the crosslinking, for example, from 50° C. to 100° C. Thus, in one embodiment, the Tg of the polymer particles in unprinted inkjet media can be set below the blocking temperature, in order to facilitate fusing and then, after fusing, the Tg will have increased in order to gain the desired anti-blocking properties. This will be discussed further below.

Another embodiment of the invention relates to an inkjet printing method comprising the steps of: A) providing an inkjet printer that is responsive to digital data signals; B) loading the inkjet printer with the inkjet recording element described above; C) loading the inkjet printer with an inkjet ink composition; D) printing on the herein-described inkjet recording element using the inkjet ink composition in response to the digital data signals; and E) fusing at least the uppermost pigment-trapping layer. In a preferred embodiment, only the uppermost fusible layer is fused.

The term "porous layer" is used herein to define a layer that absorbs applied ink by means of capillary action rather than liquid diffusion. (Similarly, the term porous element refers to an element having at least one porous layer, at least the image-receiving layer.) Porosity can be affected by the particle to binder geometry. The porosity of a mixture may be predicted based on the critical pigment volume concentration (CPVC).

As used herein, the terms "over," "above," "upper," "under," "below," "lower," and the like, with respect to layers in the inkjet media, refer to the order of the layers over the support, but do not necessarily indicate that the layers are immediately adjacent or that there are no intermediate layers.

In regard to the present method, the term "pigment-trapping layer" is used herein to define, in use, the layer in which most (more than 50% by weight), preferably at least about 75% by weight, more preferably substantially all, of the pigment colorant in the applied inkjet ink remains.

The term "dye-trapping layer," which can be applied to one or more adjacent layers, is used herein to define a layer that contributes substantially to the density of the applied image. Preferably, there are one or two dye-trapping layers. Preferably, the dye-trapping layer or layers, in use, provide in total greater than 50%, more preferably at least about 75% of the density and, most preferably substantially all, of the density of the image provided by the dye colorant in the printed inkjet ink. This density corresponds to the amount of colorant retained in the dye-trapping layer or layers.

In regard to the present method, the term "image-receiving layer" is intended to define one or more layers that are used as a pigment-trapping layer, dye-trapping layer, or dye-and-pigment-trapping layer.

In regard to the present method, the term "ink-carrier-liquid receptive layer" (sometimes also referred to as a "sump layer" or "base layer") is used herein to define a layer under the one or more image-receiving layers that absorbs a substantial amount of ink-carrier liquid. In use, a substantial amount, preferably most, of the carrier fluid for the ink is received in the ink-carrier-liquid layer or layers, but wherein the layer is not above an image-containing layer and is not itself an image-containing layer (a pigment-trapping layer or dye-trapping layer). Preferably, there is a single ink-carrier-liquid receptive layer.

The term "ink-receptive layer" or "ink-retaining layer" includes all layers that are receptive to an applied ink composition, that absorb or trap any part of the one or more ink compositions used to form the image in the inkjet recording element, including the ink-carrier fluid and/or the colorant. An ink-receptive layer, therefore, can include either an image-receiving layer, in which the image is formed by a dye and/or pigment, or an ink-carrier-liquid receptive layer in which the carrier liquid in the ink composition is absorbed upon application, although later removed by drying. Typically, all layers above the support are ink-receptive and the support may or may not be ink-receptive.

The term "thermoplastic polymer" is used herein to define the polymer flows upon application of heat, typically prior to any extensive crosslinking.

DETAILED DESCRIPTION OF THE INVENTION

The fusible, multifunctional polymer particles employed in the upper fusible, porous layer of the invention may have a particle size conducive to forming a porous layer. In a particularly preferred embodiment of the invention, the average particle size of the fusible, polymer particles suitably ranges from about 5 to about 10,000 nm, and the monodispersity of the particles (Dp) is less than 1.5, preferably less than 1.3, more preferably less than 1.1. Preferably, the fusible, polymer particles in said fusible, porous top layer range in size from about 50 to 5,000 nm, more preferably 0.1 to about 2 μm, most preferably 0.2 to 1 μm.

As indicated above, the upper fusible, porous layer can be optionally used as a pigment-trapping layer, an ink-transporting layer, or dye-and-pigment-trapping layer.

Upon fusing of the multifunctional polymer particles, the air-particle interfaces present in the original porous structure of the layer are substantially eliminated and a non-scattering, substantially continuous, protective overcoat forms over the image. In a preferred embodiment of the invention, the fusible, multifunctional polymer particles in the upper fusible, porous layer comprise a chain growth polymer, for example, a styrenic polymer, a vinyl polymer, an ethylene-vinyl chloride copolymer, a polyacrylate, poly(vinyl acetate), poly(vinylidene chloride), and/or a vinyl acetate-vinyl chloride copolymer. In a specifically preferred embodiment of the invention, the fusible, multifunctional polymer particles are comprised of a polyacrylate polymer or copolymer (for example, acrylic beads) comprising one or more monomeric units derived from an alkyl acrylate or alkyl methacrylate monomer, wherein the alkyl group preferably has 1 to 6 carbon atoms.

As indicated above, the fusible multifunctional polymer particles in the upper fusible, porous layer comprise a polymer having diverse reactive functional groups that are complementary to each other. The weight average molecular weight of the polymer can range from 5,000 to 1,000,000, and the glass transition temperature thereof preferably ranges from −50° C. to 120° C. Preferably, the Tg of the multifunctional polymer particles is above about 20° C. and less than 120° C., more preferably above 50° C. and below 90° C. and most preferably below 80° C. The multifunctional polymer may be linear or branched, and the functional groups may be on the same chain in the polymer molecule (for example, in the backbone of a linear polymer) or on different chains in the polymer molecule (for example, in the case of a branched polymer, on different chain segments), or both.

The multifunctional polymer particles may be the reaction products of a mixture of (different types of) monomers comprising one or more non-reactive monomers and two or more reactive functional monomers, each of which reactive functional monomers comprise a crosslinking-functional group that can react with a complementary crosslinking-functional group on another reactive functional monomer in a crosslinking reaction. Thus, first reactive functionalities on a first reactive functional monomeric unit in each of the multifunctional polymer particles can complementarily react with second reactive functionalities on a second reactive functional monomeric unit in the same molecule or on another molecule in the same particle or on one or more particles, in either an intramolecular crosslinking reaction and/or an inter-molecular crosslinking reaction. Such reactive functional monomers may include monomers containing one or more of the following groups: cyanate, oxazoline, epoxy, acid, anhydrides, acid chlorides, hydroxyl, phenol, acetoacetoxy, thiol and/or amine functionalities, and the like.

The upper fusible, porous layer may comprise a mixture of different particles or may comprise only the same particles. For example, the upper fusible, porous layer may comprise mixtures of (different) multifunctional polymer particles, or mixtures of multifunctional polymer particles with monofunctional or non-functional particles. Nevertheless, the multifunctional polymer particles are present in at least a substantial amount by weight in the upper fusible, porous layer. Preferably most, more preferably substantially all, most preferably all, by weight, of the particles in the upper fusible, porous layer are multifunctional polymer particles, each having complementary reaction functionality within the same polymer particle.

Preferably the multifunctional polymer particles may comprise 0.1 to 50 mole percent of reactive monomeric units, more preferably 1 to 50 mole percent, most preferably less than 30 mole percent. Too much crosslinking can result in undesirable brittleness. The multifunctional polymer particles may comprise 50 to 99.9 mole percent of non-reactive monomeric units.

Optionally, there can be added polyfunctional crosslinking compounds that comprise 0.1 to 100 mole percent of complementary reactive monomeric units, more preferably 1 to 50 mole percent, wherein the multifunctional particles can react with either other particles or the polyfunctional crosslinking compounds. The polyfunctional crosslinking compounds may comprise 0 to 99.9 mole percent of non-reactive monomeric units, the same (mono-functional) or different (polyfunctional). Such non-particulate polyfunctional crosslinking compounds are disclosed in copending U.S. Ser. No. 10/881,264 and U.S. Ser. No. 10/881,127, both herein incorporated by reference in its entirety. It is also possible for the polyfunctional crosslinking compounds to diffuse from an adjacent layer as disclosed in concurrently filed, copending U.S. Ser. No. 11/078,275, herein incorporated by reference in its entirety.

In a preferred embodiment, the multifunctional polymer particles can be characterized by a "functional group equivalent weight" (also referred to as the monomer equivalent weight) which is defined as the grams of solid containing one gram-equivalent of a functional group ("g/equivalent"). The g/equivalent ratio of a first functional group on the multifunctional polymer particles in the fusible, porous layer, more specifically on the thermoplastic polymer, to the second or complementary reactive functional groups on the particles (in total) in the inkjet recording element of the invention ranges, on average, from 1.0/0.1 to 0.1/1.0 and more preferably, on average, from 1.0/0.5 to 0.5/1.0. This may vary, for example, in the case of additional functional groups on other types of particles or compounds in reactive association with the multifunctional polymer particles.

As indicated above, the multifunctional polymer particles comprise complementary reactive functional groups. For example, a multifunctional polymer particle can comprise epoxy-functional monomeric units in combination with one or more other functional monomeric units which will react with the epoxy functional group, such as monomeric units comprising an amine, a carboxylic acid, hydroxyl, thiol, anhydride or the like reactive functionalities in the polymer particle. Similarly, an oxazoline group will complementarily react with various protic-functional monomers.

Preferred examples of oxazoline-functional monomeric units are derived from monomers such as 2-vinyl-2-oxazoline and 2-isopropenyl-2-oxazoline. Examples of functional monomeric units with protic-type reactive functionalities include those derived from acid-functional monomers such as methacrylic acid or hydroxy-functional monomers such as hydroxyalkyl (meth)acrylates, for example, hydroxyethyl (meth)acrylate. As described further below, the acid monomer can be an ethylenically unsaturated acid, monoprotic or diprotic, anhydride or monoester of a dibasic acid, which is copolymerizable with the other monomer(s) used to prepare the polymer. The most preferred acid monomers are acrylic acid, methacrylic acid, and itaconic acid.

In general, epoxy-functional reactive groups in the multifunctional polymer particle can react with carboxylic acid (—COOH), cyclic anhydride, hydroxyl (—OH), primary amine (—$NH_2$) groups or thiol groups (—SH) in the polymer particles, for example, multifunctional polymer particles can comprise monomeric units derived from an epoxy-functional monomer and one or more of the following monomers: methacrylic acid (MAA), hydroxyalkylmethacrylates such as hydroxyethylmethacrylate (HEMA), or aminoalkyl methacrylates such as aminopropylmethacrylate, all common and commercially available monomers. A catalyst may be used to speed the reaction of complementary functional groups during fusing, as will be understood by the skilled chemist. For example, in the case of alcohols, a catalyst such as 4-dimethylaminopyridine may be used to speed the reaction.

In another embodiment, oxazoline functional groups in the multifunctional polymer particle can be used to similarly react with another functional group in the same polymer particle such as a carboxylic acid, acid anhydride, amine, phenol hydroxy and thiol. In one embodiment of the invention, a multifunctional polymer particle can contain repeat units having at least one ring-opening group, an epoxide or an oxazoline group, that can react with other non-ring-opening functional groups in the same polymer particle, for example, having a protic group, such as a carboxylic acid containing monomer. Included among useful protic reactive monomers are acrylic, methacrylic, itaconic, crotonic, fumaric and maleic acids, and anhydrides thereof.

Suitable copolymerizable monomers for making the polymeric multifunctional particles include conventional vinyl monomers such as acrylates and methacrylates of the general formula:

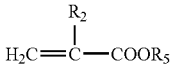

where $R_2$ is a hydrogen or alkyl, preferably methyl, and $R_5$ is a straight chain or branched aliphatic, cycloaliphatic or aromatic group having up to 20 carbon atoms which is unsubstituted or substituted. Useful or suitable copolymerizable monomers include, for example: methyl, ethyl, propyl, isopropyl, butyl, ethoxyethyl, methoxyethyl, ethoxypropyl, phenyl, benzyl, cyclohexyl, hexafluoroisopropyl, or n-octylacrylates and -methacrylates, as well as, for example, styrene, alpha-methylstyrene, 1-hexene, vinyl chloride, etc.

In one preferred embodiment of the present invention, the multifunctional polymer particle comprises an oxazoline group represented by the following formula:

(I)

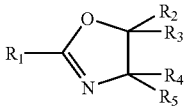

wherein $R_1$ through $R_5$ are selected so to provide a branched or unbranched vinyl oxazoline compound, for example, by selecting $R_1$ in (I) to be a branched or unbranched vinyl group according to formula (II):

(II)

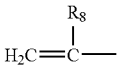

wherein $R_8$ is selected from the group consisting of hydrogen, a branched or linear $C_1$-$C_{20}$ alkyl moiety, a $C_3$-$C_{20}$ cycloalkyl moiety, a $C_6$-$C_{20}$ aryl moiety, and a $C_7$-$C_{20}$ alkylaryl moiety. If $R_1$ is such a vinyl group, $R_2$ to $R_5$ are the same or different and are selected from hydrogen, a branched or linear $C_1$-$C_{20}$ alkyl moiety, a $C_3$-$C_{20}$ cycloalkyl moiety, a $C_6$-$C_{20}$ aryl moiety and a $C_7$-$C_{20}$ alkyaryl moiety.

An oxazoline-functional monomeric unit, derived from the monomer, will provide a polymer with a moiety that is reactive to other complementary reactive functionalities on the same multifunctional polymer particle, such as —COOH, —NH, —SH and —OH (or vice versa). A detailed discussion on the preparation of oxazoline compounds can be found in Brenton et al., "Preparation of Functionalized Oxazolines," *Synthetic Communications,* 22(17), 2543-2554 (1992); Wiley et al., "The Chemistry of Oxazolines," *Chemical Reviews*, v44, 447-476 (1949); and Frump, John A., "Oxazolines, Their Preparation, Reactions, and Applications," *Chemical Reviews*, v71, 483-505 (1971), the disclosures of which are incorporated by reference.

Examples of a multifunctional polymer particle having an oxazoline group include polymers containing an oxazoline group as obtained by copolymerizing an addition-polymerizable oxazoline monomer with monomers copolymerizable therewith. Examples of the addition-polymerizable oxazoline include 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, 2-isopropenyl-4-ethyl-2-oxazoline, 2-isopropenyl-5-methyl-2-oxazoline, 2-isopropenyl-5-ethyl-2-oxazoline, and 2-isopropenyl-4,5-dimethyl-2-oxazoline. These may be used either alone respectively or in combinations with each other. The monomer 2-isopropenyl-2oxazoline, for example, a non-limiting example of a vinyl oxazoline, is represented by the following structure:

(III)

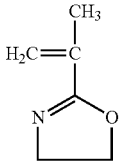

Reactive monomers that are copolymerizable with such addition-polymerizable oxazoline monomer include, by way of example, other oxazoline containing monomers, e.g., 2-vinyl-2-oxazoline, 2-vinyl-4-methyl-2-oxazoline, 2-vinyl-5-methyl-2-oxazoline, 2-isopropenyl-4-methyl-2-oxazoline, and 2-isopropenyl-5-ethyl-2-oxazoline, acrylates or methacrylates, e.g., methyl acrylate, methyl methacrylate, ethyl acrylate, ethyl methacrylate, butyl acrylate, butyl methacrylate, 2-ethylhexyl acrylate, and 2-ethylhexyl methacrylate; unsaturated carboxylic acids, e.g., acrylic acid, methacrylic acid, itaconic acid, and maleic acid; unsaturated nitriles, e.g., acrylonitrile and methacrylonitrile; unsaturated amides, e.g., acrylamide, methacrylamide, N-methylolacrylamide, and N-methylolmethacrylamide; vinyl esters, e.g., vinyl acetate and vinyl propionate; vinyl ethers, e.g., methyl vinyl ether and ethyl vinyl ether; olefins, e.g., ethylene and propylene; halogen-containing alpha-, beta-unsaturated monomers, e.g., vinyl chloride, vinylidene chloride, and vinyl fluoride; and alpha-, beta-unsaturated aromatic monomers, e.g., styrene and alpha-methylstyrene.

In another embodiment of the invention, a ring-opening reactive group in a multifunctional polymer particle is provided by an epoxy-functionality polymer. The preferred epoxy-containing multifunctional polymer particle is based on an oxirane-containing monomer such as epichlorohydrin, glycidyl methacrylate, allyl glycidyl ether, 4-vinyl-1-cyclohexene-1,2-epoxide, and the like, although other epoxy-containing monomers may be used.

The above-described multifunctional polymer particles, in one embodiment, can be synthesized from the corresponding monomers to form a colloidal dispersion of particles. In a preferred embodiment, the method comprises reacting at least two different monomers with, respectively, the two different reactive-functional groups in an aqueous solvent in the presence of a redox polymerization initiator system comprising first and second redox initiator components, an oxidizing agent and a reducing agent, wherein the temperature of reaction is maintained under about 50° C., preferably under 40° C., such that the reactive functional groups remain substantially unreacted, thereby forming a polymerization product of the monomers in the form of an aqueous dispersion of the multifunctional polymer particles having an average particle size less than 10 μm.

Redox initiator components are compounds capable, in combination, of generating ion radicals. The polymerization initiator system typically comprises a radical generator as an oxidizing agent is combined with a reducing agent. Hydrogen peroxide is an example of such a radical generator, where other possible examples include persulfates such as ammonium persulfate and potassium persulfate; hydroperoxides such as t-butylhydroperoxide and cumene hydroperoxide; secondary cerium salts, permanganates, chlorites; and hypochlorite salts. Such radical generators are preferably used in an amount of 0.01 to 10 wt %, and more preferably 0.1 to 2 wt %, of the polymerizable monomer.

As for reducing agent, suitable compounds include L-ascorbic acid or an alkaline metal salt thereof, sulfites such as sodium sulfite and sodium hydrogen sulfite; sodium thiosulfite; cobalt acetate; copper sulfate and ferrous sulfate. Such reducing agents are preferably used in an amount of 0.01 to 10 wt %, and more preferably 0.1 to 2 wt %+of the polymerizable monomer. Persulfate oxidizing agents and metasulfite reducing agents are preferred.

Preferred redox polymerization initiator systems include water-soluble initiators capable of generating ion radicals such as potassium or ammonium persulfate; potassium, sodium or ammonium persulfate, peroxides; sodium metabisulfite, and the like. Preferably, water-soluble potassium, sodium, or ammonium persulfate is employed.

The monomers for making the multifunctional polymer can form an emulsion, suspension, or soluble mixture in an aqueous solvent. Preferably, a monomer emulsion or suspension is employed in which the initiator components are soluble in the monomers.

In a preferred embodiment, the polymerization reaction is conducted at a temperature of not more than 50° C., preferably under 40° C. In one such embodiment, the method of making the multifunctional particles comprises (1) forming an aqueous monomer emulsion comprising at least two different monomers with different reactive-functional groups, a first redox initiator composition (for example, an oxidizing agent) and a surfactant, (2) forming an aqueous mixture comprising a second redox initiator (for example a reducing agent or a reducing agent and an oxidizing agent), and (3) adding the aqueous monomer emulsion to the aqueous mixture over an extended period of time to form a polymerization product of the monomers. Preferably, the aqueous mixture comprises deionized water. The dispersion product can be filtered and dispersed in a second aqueous solvent if desired.

Such a process advantageously provides very fine submicron or micron size multifunctional particles having a narrow particle size distribution. The average particle size is less than 10 μm. This contributes to improved coating properties. The dispersions also have excellent stability during storage. The concentration of the multifunctional polymeric particles in an aqueous dispersion, for use in coating, is preferably 10 to 60%, more preferably 20 to 40% by weight of solids.

Suitably, in steps (1), (2) and (3), the temperature is essentially maintained at a temperature less than about 50° C., preferably less than 40° C., such that the reactive functionalities remain substantially unreacted. Particularly, in step (3), the temperature of polymerization is maintained at a temperature less than about 50° C., preferably less than 40° C., such that the reactive functionalities remain substantially unreacted. Advantageously, in some cases, the process may be conducted at about room temperature. In any case, the temperature should be such that the reactive functionalities are substantially maintained (unreacted), as can be determined by differential scanning calorimetry (DSC), comparing the DSC of particles to fully reacted particles (subject to a temperature greater than 100° C.).

The redox polymerization initiator system can be provided in various ways. For example, the aqueous mixture in addition to the monomer emulsion can comprise an oxidizing agent, preferably, in an amount, on a molar basis, less that the reducing agent.

In the inkjet element, the multifunctional polymer particles are intended to flow and crosslink when fused, for example, in a heated fuser nip, thereby achieving inkjet surface coatings and media with excellent image quality and print durability performance.

The particle-to-binder ratio of the particles and optional binder employed in the upper fusible, porous layer can range between about 100:0 and 60:40, preferably between about 100:0 and about 90:10. In general, a layer having particle-to-binder ratios outside the range stated will usually not be sufficiently porous to provide good image quality.

The upper fusible, porous ink-trapping layer is usually present in an amount from about 1 g/m$^2$ to about 50 g/m$^2$. In a preferred embodiment, the fusible, porous layer is present in an a mount from about 1 g/m$^2$ to about 10 g/m$^2$.

Upon fusing, via the application of heat and/or pressure, the air-particle interfaces present in the original porous structure of the layer are eliminated, and a non-scattering, substantially continuous layer forms which contains the printed image. It is an important feature of the invention that the fusible, porous layer be transformable into a non-scattering layer as this significantly raises image density.

The optional porous ink-carrier-liquid receptive layer receives the ink carrier liquid after passing through the upper fusible, porous layer where substantially all the colorant has been removed. The optional porous ink-carrier-liquid receptive layer receives the ink carrier liquid after the ink has passed through the porous ink-transporting layer and through the porous dye-trapping layer where substantially all the dye has been removed. The ink-carrier-liquid receptive layer can be any conventional porous structure. In a preferred embodiment, the ink-carrier-liquid receptive layer is present in an amount from about 1 g/m$^2$ to about 50 g/m$^2$, preferably from about 10 g/m$^2$ to about 45 g/m$^2$. The thickness of this layer may depend on whether a porous or non-porous support is used.

In general, the porous ink-carrier-liquid receptive layer will have a thickness of about 1 μm to about 50 μm, and an upper fusible, porous residing thereon will usually have a thickness of about 2 μm to about 50 μm.

In a preferred embodiment of the invention, the ink-carrier-liquid receptive layer is a continuous, co-extensive porous layer that contains organic or inorganic particles. Examples of organic particles which may be used include core/shell particles such as those disclosed in U.S. Pat. No. 6,492,006 to Kapusniak et al., and homogeneous particles such as those disclosed in U.S. Pat. No. 6,475,602 to Kapusniak et al., the disclosures of which are hereby incorporated by reference. Examples of organic particles that may be used in this layer include acrylic resins, styrenic resins, cellulose derivatives, polyvinyl resins, ethylene-allyl copolymers and polycondensation polymers such as polyesters.

Examples of inorganic particles that may be used in the ink-carrier-liquid receptive layer include silica, alumina, titanium dioxide, clay, calcium carbonate, calcium metasilicate, talc, barium sulfate, or zinc oxide.

In a preferred embodiment of the invention, the porous ink-carrier liquid receptive layer comprises from about 20% by weight to about 100% by weight of particles and from about 0% to about 80% by weight of a polymeric binder, preferably from about 80% by weight to about 95% by weight of particles and from about 20% by weight to about 5% by weight of a polymeric binder. In a preferred embodiment, the polymeric binder may be a hydrophilic polymer such as poly (vinyl alcohol), poly(vinyl pyrrolidone), gelatin, cellulose ethers, poly(oxazolines), poly(vinylacetamides), partially hydrolyzed poly(vinyl acetate/vinyl alcohol), poly(acrylic acid), poly(acrylamide), poly(alkylene oxide), sulfonated or phosphated polyesters and polystyrenes, casein, zein, albumin, chitin, chitosan, dextran, pectin, collagen derivatives, collodian, agar-agar, arrowroot, guar, carrageenan, tragacanth, xanthan, rhamsan and the like. Preferably, the hydrophilic polymer is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin.

In order to impart mechanical durability to the ink carrier-liquid receptive layer, crosslinkers that act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, vinyl sulfones, pyridinium, pyridylium dication ether, methoxyalkyl melamines, triazines, dioxane derivatives, chrom alum, zirconium sulfate, boric acid and derivatives of boric acid, and the like may be used. Preferably, the crosslinker is an aldehyde, an acetal or a ketal, such as 2,3-dihydroxy-1,4-dioxane.

The porous ink-carrier-liquid receptive layer can also comprise an open-pore polyolefin, open-pore polyester or open-pore membrane. An open-pore membrane can be formed in accordance with the known technique of phase inversion. Examples of a porous ink-receiving layers comprising an open-pore membrane are disclosed in U.S. Pat. No. 6,497,941 issued Dec. 24, 2002 and U.S. Pat. No. 6,503,607 issued Jan. 7, 2003, both of Landry-Coltrain et al., hereby incorporated by reference.

In a particularly preferred embodiment of the invention, the ink carrier-liquid receptive layer is a continuous, co-extensive porous calcium-metasilicate-containing base layer comprising calcium-metasilicate needles, and optionally organic and/or inorganic particles in a polymeric binder, the length of the calcium metasilicate being from 1 μm to 50 μm. Examples of calcium metasilicate that can be used in the invention include VANSIL acicular Wollastonite. Such a material can also be represented by the commonly used formula for calcium metasilicate or $CaSiO_3$. VANSIL WG, for example, is a high aspect ratio, long needle grade of Wollastonite. Other useful grades, depending on the particular inkjet recording system, include VANSIL HR-1500 and HR-325, which are all commercially available from R.T. Vanderbilt Co., Inc., Norwalk, Conn.

As mentioned above, a first embodiment of the invention involves an upper (preferably uppermost) fusible, porous layer that is designed to preferably function as a pigment-trapping upper layer, a second embodiment of the invention involves an upper (preferably uppermost) fusible, porous layer that is designed to preferably alternatively function as both a pigment-trapping layer and a dye-trapping layer, i.e., the printed image is formed in the upper fusible, porous layer irrespective of the ink composition, and in yet a third embodiment, the upper fusible, porous layer is designed to preferably function as an ink-transporting layer above a lower fusible, porous dye-trapping layer comprising fusible polymer particles (not necessarily crosslinkable), an optional dye mordant, and an optional hydrophilic binder.

In this third embodiment, the upper fusible, porous layer may, in addition, contain a film-forming hydrophobic binder, which may be advantageous in the case of a lower dye-trapping layer that is also fusible. The presence of a minor amount of binder may provide more pre-fusing raw-stock keeping, durability, and handling capability. The film-forming, hydrophobic binder useful in the invention can be any film-forming hydrophobic polymer capable of being dispersed in water. In a preferred embodiment of the invention, however, there is no binder. If a binder is used, it preferably should be used in a minor amount.

In the case of the upper fusible, porous layer designed to preferably function as an ink-transporting layer in combination with a fusible dye-trapping layer that receives the ink from the upper ink-transporting layer, the fusible dye-trapping layer preferably retains substantially all the dye, and can allow for the passage of the ink carrier liquid to an optional underlying porous ink-carrier-liquid-receptive layer and/or an optionally porous support.

Upon fusing, via the application of heat and/or pressure, the air-particle interfaces present in the original porous structure of the dye-trapping layer (also referred to as the image layer) are eliminated, and a non-scattering, substantially continuous layer forms which contains the printed image. It is an important feature of this embodiment of the invention that both the fusible, porous ink-transporting layer and the underlying dye-trapping layer be transformable into a non-scattering layer as this significantly raises image density.

The fusible, polymer particles employed in the dye-trapping layer of this embodiment of the invention typically range from about 0.1 μm to 10 μm, although smaller particles are possible. The particles employed in the dye-trapping layer may be formed from any polymer that is fusible, i.e., capable of being converted from discrete particles into a substantially continuous layer through the application of heat and/or pressure. In a preferred embodiment of the invention, the fusible, polymer particles comprise the ester derivative of a natural polymer, such as cellulose acetate butyrate, a condensation polymer, such as a polyester or a polyurethane, or an addition polymer, for example, a styrenic polymer, a vinyl polymer, an ethylene-vinyl chloride copolymer, a polyacrylate, poly(vinyl acetate), poly(vinylidene chloride), or a vinyl acetate-vinyl chloride copolymer, and the like.

The binder employed in the dye-trapping layer can be any film-forming polymer that serves to bind together the fusible polymer particles. In a preferred embodiment, the binder is a hydrophobic film-forming binder derived from an aqueous dispersion of an acrylic polymer, a vinyl acetate polymer, or polyurethane.

A dye mordant is preferably employed in the dye-trapping layer. Such a dye mordant can be any material that is effectively substantive to the inkjet dyes. The dye mordant removes dyes from the ink received from the porous ink-transporting layer and fixes the dye within the dye-trapping layer. Examples of such mordants include cationic lattices such as disclosed in U.S. Pat. No. 6,297,296 and references cited therein, cationic polymers such as disclosed in U.S. Pat. No. 5,342,688, and multivalent ions as disclosed in U.S. Pat. No. 5,916,673, the disclosures of which are hereby incorporated by reference. Examples of these mordants include polymeric quaternary ammonium compounds, or basic polymers, such as poly(dimethylaminoethyl)-methacrylate, polyalkylenepolyamines, and products of the condensation thereof with dicyanodiamide, amine-epichlorohydrin polycondensates. Further, lecithins and phospholipid compounds can also be used. Specific examples of such mordants include the following: vinylbenzyl trimethyl ammonium chloride/ethylene glycol dimethacrylate; poly(diallyl dimethyl ammonium chloride); poly(2-N,N,N-trimethylammonium)ethyl methacrylate methosulfate; poly(3-N,N,N-trimethyl-ammonium)propyl methacrylate chloride; a copolymer of vinylpyrrolidinone and vinyl(N-methylimidazolium chloride; a copolymer of vinyl alcohol and vinyl amine or its quaternized ammonium analogue; and hydroxyethylcellulose derivatized with 3-N,N,N-trimethylammonium)propyl chloride. In a preferred embodiment, the cationic mordant is a quaternary ammonium compound.

In order to be compatible with the mordant, both the binder and the polymer comprising the fusible particles is preferably either uncharged or the same charge as the mordant. Colloidal instability and unwanted aggregation could result if the polymer particles or the binder had a charge opposite from that of the mordant.

In one particular embodiment, the fusible particles in the dye-trapping layer may range from about 95 to about 60 parts by weight, the binder may range from about 40 to about 5 parts by weight, and the dye mordant may range from about 2 parts to about 40 parts by weight. More preferably, the dye-trapping layer comprises about 80 parts by weight fusible particles, about 10 parts by weight binder, and about 10 parts by weight dye mordant. The dye-trapping layer can be present in the recording element in an amount by weight of from about 1 g/m$^2$ to about 50 g/m$^2$, more preferably in an amount from about 1 g/m$^2$ to about 10 g/m$^2$.

The support used in the inkjet recording element of the invention may be opaque, translucent, or transparent. There may be used, for example, plain papers, resin-coated papers, various plastics including a polyester resin such as poly(ethylene terephthalate), poly(ethylene naphthalate) and poly(ester diacetate), a polycarbonate resin, a polylactic acid, a fluorine resin such as poly(tetra-fluoro ethylene), metal foil, various glass materials, and the like. In a preferred embodiment, the support is an open-structure paper support as used in the Examples below. The thickness of the support employed in the invention can be from about 12 to about 500 μm, preferably from about 75 to about 300 μm.

If desired, in order to improve the adhesion of the base layer to the support, the surface of the support may be corona-discharge-treated prior to applying the base layer or solvent-absorbing layer to the support.

Since the inkjet recording element may come in contact with other image recording articles or the drive or transport mechanisms of image recording devices, additives such as surfactants, lubricants, matte particles and the like may be added to the element to the extent that they do not degrade the properties of interest.

Also, a backside coating may be coated on the opposite side of the support of the inkjet recording element to provide water and stain resistance, front to back thermal blocking resistance, acceptable raw stock keeping, and curl balance. A preferred coating to impart some or all of the characteristics just mentioned is a polymeric coating, such as a polymer latex, containing dispersed hydrophobic polymer particles. Additionally, since this backside coating, like the front side coating, may come in contact with other image recording articles or the drive or transport mechanisms of image recording devices, additives such as surfactants, lubricants, inorganic particles to provide reinforcement, matte spacer particles and the like may be added to the coating to the extent that they do not degrade the properties of interest.

The layers described above, including the ink-carrier-liquid receptive layer and the upper fusible, porous layer, may be coated by conventional coating means onto a support material commonly used in this art. Depending on the embodiment, a dye-trapping layer and an ink-transporting layer may be similarly coated onto a support material. Coating methods may include, but are not limited to, wound wire rod coating, air-knife coating, slot coating, slide hopper coating, gravure, curtain coating and the like. Some of these methods allow for simultaneous coatings of all three layers, which is preferred from a manufacturing economic perspective.

After printing on the element of the invention, the upper fusible, porous is heat and/or pressure fused to form a substantially continuous overcoat layer on the surface. Upon fusing, this layer is rendered non-light scattering. The fusing and concurrent crosslinking should be sufficiently complete. Insufficient fusing or crosslinking can result in a tacky surface and, if the fusible, porous layer remains porous, the inkjet element will not be water and stain resistant, as well as not have the desired anti-blocking properties.

Fusing may be accomplished in any manner that is effective for the intended purpose. A description of a fusing method employing a fusing belt can be found in U.S. Pat. No. 5,258,256, and a description of a fusing method employing a fusing roller can be found in U.S. Pat. No. 4,913,991, the disclosures of which are hereby incorporated by reference. If a fusing roller is used, it is advantageously facilitated by the low Tg reactive polymer particles of the present invention.

In a preferred embodiment, fusing is accomplished by contacting the surface of the element with a heat-fusing member, such as a fusing roller or fusing belt. Thus, for example, fusing can be accomplished by passing the element, with or without a release liner in contact with the fusible surface, through a pair of heated rollers, heated to a temperature of about 60° C. to about 160° C., using a pressure of 5 to about 15 MPa at a transport rate of about 0.005 m/sec to about 0.5 m/sec.

As mentioned above, lower initial Tg for the fusible polymer particles can be an advantage for fusing at relatively lower temperatures and/or lower pressures, for example less than about 300° F., instead of 350° F. as required for some prior art fusible polymer particles of a cellulose ester. Following fusing and crosslinking, a higher Tg for the top layer of the inkjet element is obtained so that blocking problems are avoided. Also, a further advantage of inkjet media that can be made in accordance with the present invention is that, since less heat may be required to fuse the element, the inkjet element can be released from the fusing element when relatively hot without deformation and without lowering gloss or adversely affecting a smooth surface. This facilitates the use of a fuser roller as compared to a belt fuser that may otherwise be needed to provide longer contact so that the inkjet element has sufficient time to cool before release.

Inkjet recording element according to the present invention can be printed with pigmented or dye-based inks, or mixtures thereof. Inkjet inks that can be used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543; and 4,781,758, the disclosures of which are hereby incorporated by reference.

The following examples further illustrate the invention.

EXAMPLES

Polymer particle dispersions P-1 to P-11 were prepared as follows. Unless otherwise indicated, the particle size was measured by a Microtrac® Ultra Fine Particle Analyzer (Leeds and Northrup) at a 50% median value.

Synthesis of Polymer Particles P-1

The polymer particle dispersions were prepared by an emulsion polymerization technique employing the following components:

| | | |
|---|---|---|
| Part A: | Deionized water | (100 g) |
| | Potassium persufate | (0.15 g) |
| | $Na_2S_2O_5$ (Sodium metasulfite) | (0.9 g) |
| Part B: | Deionized water | (120 g) |
| | Glycidyl methacrylate | (5.37 g) |
| | Ethyl methacrylate | (17.4 g) |
| | Butyl methacrylate | (39.0 g) |
| | Methylacrylic acid | (3.25 g) |

-continued

| | |
|---|---|
| Potassium persulfate | (0.8 g) |
| SDS | (0.25 g) |
| 3-Mercaptopropionic acid | (0.75 g) |

Part (A) was first charged to a 1 L 3-neck flask equipped with a nitrogen-inlet, mechanical stirrer and condenser. The flask was immersed in a constant temperature bath at 35° C. and purged with nitrogen for 20 min.

Part (B) was added to the mixture. Agitation was maintained all the time during the feeding of monomer emulsion. The addition time of the monomer emulsion (B) was two hours.

The polymerization was continued for 30 min after the addition of the monomer emulsion.

The mixture was cooled to room temperature and filtered. The final solids were about 22% and the final particle size was about 0.51 μm. The monodispersity was 1.03 as determined by UPA. The average molecular weight of sample P-1 was 46,000 (number-average) and 97,000 (weight-average).

The synthesis of polymer particles P-2 to P-11 was performed in the same way as the above sample, except that different compositions or monomers were used.

The Table 1 below shows the detail of the different polymer compositions.

TABLE 1

| Sample | Polymer composition | | Average Particle Size (□m) (number weighted) | Mono-disper-sity |
|---|---|---|---|---|
| P-1 | Glycidyl methacrylate<br>Ethyl methacrylate<br>Butyl methacrylate<br>Methacrylic acid | (8/27/60/5) | 0.5112 | 1.03 |
| P-2 | Glycidyl methacrylate<br>Ethyl methacrylate<br>Butyl methacrylate<br>Methacrylic acid | (8/52/35/5) | 0.2876 | 1.05 |
| P-3 | Glycidyl methacrylate<br>Ethyl methacrylate<br>Butyl methacrylate<br>Methacrylic acid | (8/10/77/5) | 0.4467 | 1.06 |
| P-4 | Ethyl methacrylate<br>Butyl methacrylate | (80/20) | 0.4 | 1.05 |
| P-5 | Ethyl methacrylate<br>Butyl methacrylate<br>Methacrylic acid | (85/10/5) | 0.611 | 1.06 |
| P-6 | Glycidyl methacrylate<br>Ethyl methacrylate<br>Butyl methacrylate<br>Methacrylic acid | (16/16/58/10) | 0.5081 | 1.03 |
| P-7 | Glycidyl methacrylate<br>Ethyl methacrylate<br>Butyl methacrylate<br>Methacrylic acid | (16/43/31/10) | 0.5516 | 1.02 |
| P-8 | Ethyl methacrylate<br>Butyl methacrylate<br>Methacrylic acid | (35/60/5) | 0.737 | 1.05 |
| P-9 | Hydroxyethyl methacrylate<br>Ethyl methacrylate<br>Butyl methacrylate<br>Methacrylic acid | (7/26/62/5) | 0.334 | 1.02 |
| P-10 | Hydroxyethyl acrylate<br>Ethyl methacrylate<br>Butyl methacrylate<br>Methacrylic acid | (7/26/62/5) | 0.718 | 1.04 |
| P-11 | Hydroxyethyl methacrylate<br>Ethyl methacrylate<br>Butyl methacrylate<br>Methacrylic acid | (11/20/61/8) | 0.95 | 1.1 |

Various inkjet recording elements according to the present invention were prepared as follows:

Example 1

A 25% solids aqueous, solution was made containing calcium metasilicate (HR325 WOLLASTONITE from R.T. Vanderbilt Company Inc., Norwalk, Conn.), plastic pigment latex (HS3000 NA high-Tg acrylic hollow beads (1 μm), from Dow Chemical, Marietta, Ga.), and polyvinyl alcohol (GH17 GOHSENOL from Nippon Gohsei, Osaka, Japan) at a dry weight ratio of 45/45/10. This was then coated and dried at a dry laydown of 26.9 g/m$^2$ (2.5 g/ft$^2$) on DOMTAR QUANTUM 80 paper using a hopper coater to provide an ink-carrier-liquid-receptive layer on a support.

Example 2

Dispersion P-8 was diluted to make an 18% aqueous dispersion. This was then coated over the ink-carrier-liquid receptive layer of Example 1 at a dry laydown of 8.6 g/m$^2$ (0.8 g/sqft) and dried to form a comparative recording element, comprising a fusible porous layer comprising non-reactive thermoplastic polymer particles.

Example 3

Polymer Particle Dispersion P-1 was used to make an 18% aqueous solution. This was then coated over the ink-carrier-liquid receptive layer of Example 1 at a dry laydown of 8.6 g/m$^2$ (0.8 g/sq ft) and dried to form a recording element according to the present invention.

Example 4

Polymer Particle Dispersion P-2 was used to make an 18% aqueous solution. This was then coated over the ink-carrier-liquid receptive layer of Example 1 at a dry laydown of 8.6 g/m$^2$ (0.8 g/sq ft) and dried to form a recording element according to the present invention.

Example 5

Polymer Particle Dispersion P-3 was used to make an 18% aqueous solution. This was then coated over the ink-carrier-liquid receptive layer of Example 1 at a dry laydown of 8.6 g/m$^2$ (0.8 g/sq ft) and dried to form a recording element according to the present invention.

Example 6

Polymer Particle Dispersion P-6 was used to make an 18% aqueous solution. This was then coated over the ink-carrier-liquid receptive layer of Example 1 at a dry laydown of 8.6 g/m$^2$ (0.8 g/sq ft) and dried to form a recording element according to the present invention.

Example 7

Polymer Particle Dispersion P-7 was used to make an 18% aqueous solution. This was then coated over the ink-carrier-liquid receptive layer of Example 1 at a dry laydown of 8.6 g/m$^2$ (0.8 g/sq ft) and dried to form a recording element according to the present invention.

Example 8

A dispersion of (1) polymeric particles P-4, (2) the colloidal cationic mordant divinylbenzene-co-N-vinylbenzyl-N,N,N-trimethylammonium chloride, and (3) poly(vinyl alcohol) (GH17 GOHENSOL from Nippon Gohsei) were diluted at the dry weight ratio of 75/15/10 to make an 18% aqueous dispersion, based on dry weight of particles in the dispersion. This was then coated over the ink-carrier-liquid receptive layer of Example 1 at a dry laydown of 6.2 g/m$^2$ (0.6 g/sqft) and dried to form a recording element comprising a dye-trapping layer coated over an ink-carrier-liquid-receptive layer on a support.

Example 9

Polymer Particle Dispersion P-5 was diluted to make an 18% aqueous solution. This was then coated over the dye-trapping layer of Example 8 at a dry laydown of 8.6 g/m$^2$ (0.8 g/sq ft) and dried to form a comparative recording element comprising an ink-receptive layer coated over a dye trapping layer coated over an ink-carrier-liquid receptive layer on a support.

Example 10

Polymer Particle Dispersion P-1 was used to make an 18% aqueous solution. This was then coated over Example 8 at a dry laydown of 6.2 g/m$^2$ (0.6 g/sq ft) and dried to form a recording element according to the present invention.

Example 11

Polymer Particle Dispersion P-2 was used to make an 18% aqueous solution. This was then coated over Example 8 at a dry laydown of 6.2 g/m$^2$ (0.6 g/sq ft) and dried to form a recording element according to the present invention.

Example 12

Polymer Particle Dispersion P-3 was used to make an 18% aqueous solution. This was then coated over Example 8 at a dry laydown of 6.2 g/m$^2$ (0.6 g/sq ft) and dried to form a recording element according to the present invention.

Example 13

Polymer Particle Dispersion P-6 was used to make an 18% aqueous solution. This was then coated over Example 8 at a dry laydown of 6.2 g/m$^2$ (0.6 g/sq ft) and dried to form a recording element according to the present invention.

Example 14

Polymer Particle Dispersion P-7 was used to make an 18% aqueous solution. This was then coated over Example 8 at a dry laydown of 6.2 g/m$^2$ (0.6 g/sq ft) and dried to form a recording element according to the present invention.

Example 15

Polymer Particle Dispersion P-9 was used to make an 18% aqueous solution. This was then coated over the ink-carrier-liquid receptive layer of Example 1 at a dry laydown of 8.6 g/m$^2$ (0.8 g/sq ft) and dried to form a recording element according to the present invention.

Example 16

Polymer Particle Dispersion P-10 was used to make an 18% aqueous solution. This was then coated over the ink-carrier-liquid receptive layer of Example 1 at a dry laydown of 8.6 g/m$^2$ (0.8 g/sq ft) and dried to form a recording element according to the present invention.

Example 17

Polymer Particle Dispersion P-11 was used to make an 18% aqueous solution. This was then coated over the ink-carrier-liquid receptive layer of Example 1 at a dry laydown of 8.6 g/m$^2$ (0.8 g/sq ft) and dried to form a recording element according to the present invention.

Printing

Examples 2 through 7, Examples 9 through 14, and Examples 15 through 17 were printed with a CANON i960 inkjet printer with Eastman Kodak pigment inks, with a test target comprised of 1 cm$^2$ color patches, a set of each of the primary and secondary colors. Each patch was printed at 100% density.

Examples 9 through 14 were also printed with a CANON i550 printer with the installed CANON dye-based inks, with a test target comprised of 1 cm$^2$ color patches, a set of each of the primary and secondary colors. Each patch was printed at 100% density.

Fusing and Testing

The printed elements were allowed to dry for 1 hour and then were fused in a heated nip at 125° C. and 4.2 kg/cm$^2$ against a sol-gel coated polyimide belt at 76 cm/min. A drop of water, coffee, and fruit punch (HAWAIIAN PUNCH, which contains Red Dye #40 and Blue Dye #1) were placed on the color patches and a white non-printed area and allowed to set for 10 minutes and then blotted off. Each area where a drop was placed was visually inspected for any stain, watermarks, and deformations to the surfaces. If any stain, watermark, or deformation was detected it was assigned a failing grade. If no stain, watermark or deformation was seen it was assigned a passing grade. Table 2 summarizes the results:

TABLE 2

| Recording Element | Top Layer | Intermediate Layer | Ink | Stain Test |
|---|---|---|---|---|
| Comp. Example 2 | P-8 (non-react) | — | Pigment | Fail |
| Example 3 | P-1 | — | Pigment | Pass |
| Example 4 | P-2 | — | Pigment | Pass |
| Example 5 | P-3 | — | Pigment | Pass |
| Example 6 | P-6 | — | Pigment | Pass |
| Example 7 | P-7 | — | Pigment | Pass |
| Comp. Example 9 | P-5 (non-react) | P-4, mordant, PVA | Pigment | Fail |

TABLE 2-continued

| Recording Element | Top Layer | Intermediate Layer | Ink | Stain Test |
|---|---|---|---|---|
| Example 10 | P-1 | P-4, mordant, PVA | Pigment | Pass |
| Example 11 | P-2 | P-4, mordant, PVA | Pigment | Pass |
| Example 12 | P-3 | P-4, mordant, PVA | Pigment | Pass |
| Example 13 | P-6 | P-4, mordant, PVA | Pigment | Pass |
| Example 14 | P-7 | P-4, mordant, PVA | Pigment | Pass |
| Comp. Example 9 | P-5 (non-react) | P-4, mordant, PVA | Dye | Fail |
| Example 10 | P-1 | P-4, mordant, PVA | Dye | Pass |
| Example 11 | P-2 | P-4, mordant, PVA | Dye | Pass |
| Example 12 | P-3 | P-4, mordant, PVA | Dye | Pass |
| Example 13 | P-6 | P-4, mordant, PVA | Dye | Pass |
| Example 14 | P-7 | P-4, mordant, PVA | Dye | Pass |
| Example 15 | P-9 | — | Pigment | Pass |
| Example 16 | P-10 | — | Pigment | Pass |
| Example 17 | P-11 | — | Pigment | Pass |

The data clearly shows that in all cases where the multifunctional polymer particles are used to thermally set the coatings, excellent stain resistance was obtained. When no such multifunctional polymer particles were used, poor stain resistance was obtained.

The invention has been described with reference to a preferred embodiment. However, it will be appreciated that variations and modifications can be effected by a person of ordinary skill in the art without departing from the scope of the invention.

The invention claimed is:

1. An inkjet recording element comprising a support having thereon a fusible, porous layer comprising fusible multifunctional polymer particles that comprise a thermoplastic polymer containing in the same molecule both a crosslinking functional group and a complementary crosslinking functional group.

2. The element of claim 1 wherein the fusible, porous layer is the uppermost porous layer in the element.

3. The element of claim 2 further comprising an ink-carrier-liquid receptive layer between the support and the fusible, porous layer.

4. The element of claim 1 wherein the support optionally functions as a liquid-absorbing layer either alone or in combination with an ink-carrier-liquid receptive layer.

5. The element of claim 1 wherein the number average molecular weight of the thermoplastic polymer is from 5,000 to 1,000,000 and the glass transition temperature is above about 20° C. and less than about 100° C.

6. The element of claim 1, wherein the thermoplastic polymer comprising the multifunctional polymer particles are in reactive association with a polyfunctional compound comprising 0.1 to 100 mole percent of monomeric units having a reactive functionality that is capable of crosslinking with the multifunctional polymer particles and also 0 to 99.9 mole percent of monomeric units that are derived from non-reactive monomers.

7. The element of claim 1, wherein one of the crosslinking functional group and the complementary crosslinking functional group comprises a hydroxyl group and the other comprises an epoxy group.

8. The element of claim 1, wherein one of the crosslinking functional group and the complementary crosslinking functional group comprises a hydroxyl group and the other comprises a carboxylic acid group.

9. The element of claim 1, wherein one of the crosslinking functional group and the complementary crosslinking functional group comprises an oxazoline group and the other comprises a carboxylic acid group.

10. The element of claim 1, wherein one of the crosslinking functional group and the complementary crosslinking functional group comprises an epoxy group and the other comprises a carboxylic acid group.

11. The element of claim 1, wherein one of the crosslinking functional group and the complementary crosslinking functional group comprises an acetoacetoxy and the other comprises an amine functionality.

12. The element of claim 1, one of the crosslinking functional group and the complementary crosslinking functional group comprises an epoxy and the other comprises an amine functionality.

13. The element of claim 1, wherein one of the crosslinking functional group and the complementary crosslinking functional group comprises an anhydride and the other comprises an amine functionality.

14. The element of claim 1 wherein between the fusible, porous layer and the support is at least one porous, ink-carrier-liquid receptive layer, wherein the porous, ink-carrier-liquid receptive layer comprises from about 50% by weight to about 95% by weight of particles and from about 50% by weight to about 5% by weight of a polymeric binder.

15. The element of claim 1 wherein the fusible, porous layer comprises no binder.

16. The element of claim 14 wherein the particles in the ink-carrier-liquid receptive layer comprise silica, alumina, titanium dioxide, clay, talc, calcium carbonate, barium sulfate, zinc oxide or mixtures thereof

17. The element of claim 16 wherein the ink-carrier-liquid receptive layer further comprises a polymeric binder that is poly(vinyl alcohol), hydroxypropyl cellulose, hydroxypropyl methyl cellulose, a poly(alkylene oxide), poly(vinyl pyrrolidinone), poly(vinyl acetate) or copolymers thereof or gelatin.

18. The element of claim 14 wherein the particles in the ink-carrier-liquid receptive layer comprise organic particles.

19. The element of claim 1 wherein the fusible multifunctional polymer particles range in size from about 0.1 to about 10 μm.

20. The element of claim 1 wherein, under the fusible, porous layer, the element further comprises a lower fusible porous layer that is a dye-trapping layer comprising fusible polymer particles, a dye mordant and an optional binder and, below the dye-trapping layer, an optional ink-carrier-liquid receptive layer.

21. The element of claim 20 wherein the fusible polymer particles in the fusible, dye-trapping layer comprise a derivative of a natural polymer, a condensation polymer selected from the group consisting of polyester and polyurethane, or an additional polymer selected from the group consisting of a styrenic polymer, vinyl polymer, ethylene-vinyl chloride copolymer, polyacrylate, poly(vinyl acetate), poly(vinylidene chloride), and vinyl acetate-vinyl chloride copolymer.

22. An inkjet recording element of claim 1, wherein the thermoplastic polymer comprising the fusible multifunctional polymer particles is a polyacrylate polymer or copolymer comprising one or more monomeric units derived from an alkyl acrylate or an alkyl methacrylate monomer, wherein the alkyl group has 1 to 10 carbon atoms, wherein the fusible multifunctional polymer particles have a monodispersity less than 1.3; and wherein the crosslinking functional group and the complementary crosslinking functional group, respectively, are selected from the group consisting of a hydroxyl group and an epoxy group, a hydroxyl group and carboxylic acid group, an oxazoline group and carboxylic acid group, an epoxy group and a carboxylic acid group, an acetoacetoxy and amine functionality, an epoxy and amine functionality, and an anhydride and amine functionality;

the element further comprising an ink-carrier-liquid receptive layer between the support and the fusible, porous layer, wherein the porous, ink-carrier-liquid receptive layer comprises from about 50% by weight to about 95% by weight of particles and from about 50% by weight to about 5% by weight of a polymeric binder.

23. An inkjet recording element of claim 1, wherein the thermoplastic polymer comprising the fusible multifunctional polymer particles is a polyacrylate polymer or copolymer comprising one or more monomeric units derived from an alkyl acrylate or an alkyl methacrylate monomer, wherein the alkyl group has 1 to 10 carbon atoms, wherein the fusible multifunctional polymer particles have a monodispersity less than 1.3;

wherein the crosslinking functional group and the complementary crosslinking functional group, respectively, are selected from the group consisting of a hydroxyl group and an epoxy group, a hydroxyl group and carboxylic acid group, an oxazoline group and carboxylic acid group, an epoxy group and a carboxylic acid group, an acetoacetoxy and amine functionality, an epoxy and amine functionality, and an anhydride and amine functionality; and wherein, under the fusible, porous layer, the element further comprises a lower fusible porous layer that is a dye-trapping layer comprising fusible polymer particles, a dye mordant, and an optional binder and, below the dye-trapping layer, an optional ink-carrier-liquid receptive layer.

* * * * *